US008622776B2

(12) United States Patent
Morikawa et al.

(10) Patent No.: US 8,622,776 B2
(45) Date of Patent: Jan. 7, 2014

(54) TERMINAL FITTING AND ELECTRIC WIRE EQUIPPED WITH THE SAME

(75) Inventors: Satoshi Morikawa, Yokkaichi (JP); Kazumasa Kobayashi, Yokkaichi (JP); Takuji Otsuka, Yokkaichi (JP); Hiroki Shimoda, Yokkaichi (JP)

(73) Assignees: Autonetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 13/583,034

(22) PCT Filed: Mar. 11, 2011

(86) PCT No.: PCT/JP2011/055752

§ 371 (c)(1),
(2), (4) Date: Sep. 6, 2012

(87) PCT Pub. No.: WO2011/115006

PCT Pub. Date: Sep. 22, 2011

(65) Prior Publication Data

US 2012/0329341 A1 Dec. 27, 2012

(30) Foreign Application Priority Data

Mar. 15, 2010 (JP) ..... 2010-057670

(51) Int. Cl.
*H01R 4/10* (2006.01)
*H01R 4/18* (2006.01)

(52) U.S. Cl.
USPC ..... 439/886; 439/883; 439/936

(58) Field of Classification Search
USPC ..... 439/883, 886, 936
See application file for complete search history.

(56) References Cited

U.S. PATENT DOCUMENTS

| | | | | |
|---|---|---|---|---|
| 2,296,443 | A * | 9/1942 | Kleinfelder | 403/390 |
| 3,259,874 | A * | 7/1966 | Esser | 439/423 |
| 3,812,448 | A | 5/1974 | Haitmanek | |
| 4,142,771 | A * | 3/1979 | Barnes et al. | 439/442 |
| 4,673,238 | A * | 6/1987 | Westover et al. | 439/890 |
| 4,922,058 | A * | 5/1990 | Rodrigues | 174/94 R |
| 5,137,478 | A * | 8/1992 | Graf et al. | 439/874 |
| 5,532,433 | A * | 7/1996 | Endo et al. | 174/84 C |
| 6,056,605 | A * | 5/2000 | Nguyen et al. | 439/882 |

(Continued)

FOREIGN PATENT DOCUMENTS

| | | |
|---|---|---|
| JP | 49-82991 | 8/1974 |
| JP | 2-291681 | 12/1990 |
| JP | 2005-339850 | 12/2005 |

*Primary Examiner* — James Harvey
(74) *Attorney, Agent, or Firm* — Gerald E. Hespos; Michael J. Porco; Matthew T. Hespos

(57) ABSTRACT

A terminal fitting 10 having a wire barrel 31 crimping the terminal of an exposed core wire 42 of a coated electric wire 40, an insulation barrel 32 provided in the rear of the wire barrel 31 and fixing the coated electric wire 40, and a coupling portion 33 coupling the wire barrel 31 and the insulation barrel 32 to each other. The coupling portion 33 having a surface coming in contact with the coated electric wire 40 has a lead-in groove 36 to introduce an anti-corrosive agent. The lead-in groove extends in a direction intersecting with the axial direction of the coated electric wire 40 such that at least one of end portions is opened at the side edge of the coupling portion 33.

12 Claims, 12 Drawing Sheets

(56) References Cited

U.S. PATENT DOCUMENTS 7,125,295 B2 * 10/2006 Zhao et al. ..... 439/883
7,210,958 B1 * 5/2007 Jacques et ..... 439/421
7,901,257 B2 * 3/2011 Okamura et al. ..... 439/877
2005/0221691 A1 * 10/2005 Li ..... 439/886
2012/0329341 A1 * 12/2012 Morikawa et al. ..... 439/866

* cited by examiner

TERMINAL FITTING AND ELECTRIC WIRE EQUIPPED WITH THE SAME

BACKGROUND OF THE INVENTION

1. Field of the Invention

The present invention relates to a terminal fitting connected to an electric wire and an electric wire equipped with the terminal fitting.

2. Description of the Related Art

Conventionally, one described in, for example, Japanese Unexamined Patent Publication No. 2005-339850 has been known as a terminal fitting connected to the terminal of an electric wire. The terminal fitting has a body portion connected with a mating conductor and, in the rear of the body portion, a crimping portion at which the terminal of a core wire in the coated electric wire is crimped and fixed.

When the coated electric wire is electrically connected to the terminal fitting, in a case where the core wires of the coated electric wire and the terminal fitting are made of different kinds of metals, if water exists at a portion where the two come in contact with each other, it is known that the metals both dissolve in water in the shape of ions to give rise to electric corrosion in which corrosion makes progress by electrochemical reaction. To inhibit occurrence of such electric corrosion, the terminal fitting disclosed in Japanese Unexamined Patent Publication No. 2005-339850 has a water-tight structure in which the gap between the crimping portion and the coated electric wire is filled with a waterproof sealing agent (anti-corrosive agent).

In a configuration where the coated electric wire is electrically connected by crimping the coated electric wire at the crimping portion of the terminal fitting, it is difficult to deform the crimping portion into a shape completely conforming to the outer circumferential portions of the coated electric wire and the core wires. That is, the coated electric wire and the core wires each have a substantially circular cross section, whereas the crimping portion has a substantially rectangular or a substantially U-shaped cross section. Therefore, in the right and left diametrical directions of the coated electric wire and the core wires, outer circumferential portions thereof and the side walls of the crimping portion come in close contact with each other, whereas a gap is formed between both ends of the bottom wall of the crimping portion, that is, bent portions and the outer circumferential portions of the coated electric wire as well as the core wires. As a result, an anti-corrosive agent dropped or sprayed from above the terminal fitting may not easily enter the gap between the crimping portion and the coated electric wire as well as core wires.

The present invention was made in view of the foregoing circumstances. It is an object of the present invention to provide a terminal fitting configured to prevent the occurrence of electric corrosion at a portion to which an electric wire is connected. It is another object of the present invention to provide an electric wire equipped with the terminal fitting to which the terminal fitting is connected.

SUMMARY OF THE INVENTION

To solve the above problems, in a terminal fitting to be connected to a coated electric wire according to the present invention, the terminal fitting includes: a wire barrel to be crimped on an exposed terminal of a core wire included in the coated electric wire; an insulation barrel provided in a rear of the wire barrel; and a coupling portion coupling the wire barrel and the insulation barrel to each other. The insulation barrel is configured to fix the coated electric wire. The coupling portion has a lead-in groove on a surface that is in contact with the coated electric wire. The lead-in groove is configured to introduce an anti-corrosive agent. The lead-in groove extends in a direction intersecting with an axial direction of the coated electric wire such that at least one end portion thereof is opened at at least one side edge of the coupling portion.

In this configuration, when an anti-corrosive agent is applied after the coated electric wire is crimped and fixed to the terminal fitting, the anti-corrosive agent enters an opening of the lead-in groove in the coupling portion. In this context, even when the coated electric wire is in close contact with the coupling portion of the terminal fitting, the anti-corrosive agent can enter the site below the coated electric wire at the coupling portion through the lead-in groove. Then, the anti-corrosive agent fills the lead-in groove to thereby form an anti-corrosive wall along the lead-in groove, that is, in a direction intersecting with the axial direction of the coated electric wire, in a manner to enclose the outer circumferential portion of the coated electric wire. Moreover, even when there is a gap partially between the coupling portion and the coated electric wire, the gap is filled with the anti-corrosive agent spilt over from the lead-in groove. In such a manner, the gap between the coated electric wire and (the lead-in groove in) the coupling portion can be securely filled with the anti-corrosive agent to prevent water content from entering from the side of the insulation barrel to the side of the wire barrel. Therefore, this configuration prevents the occurrence of electric corrosion.

According to the present invention, it is possible to prevent the occurrence of electric corrosion at a portion where the terminal fitting and the electric wire come in contact with each other.

DETAILED DESCRIPTION OF THE PREFERRED EMBODIMENTS

Figure 1:
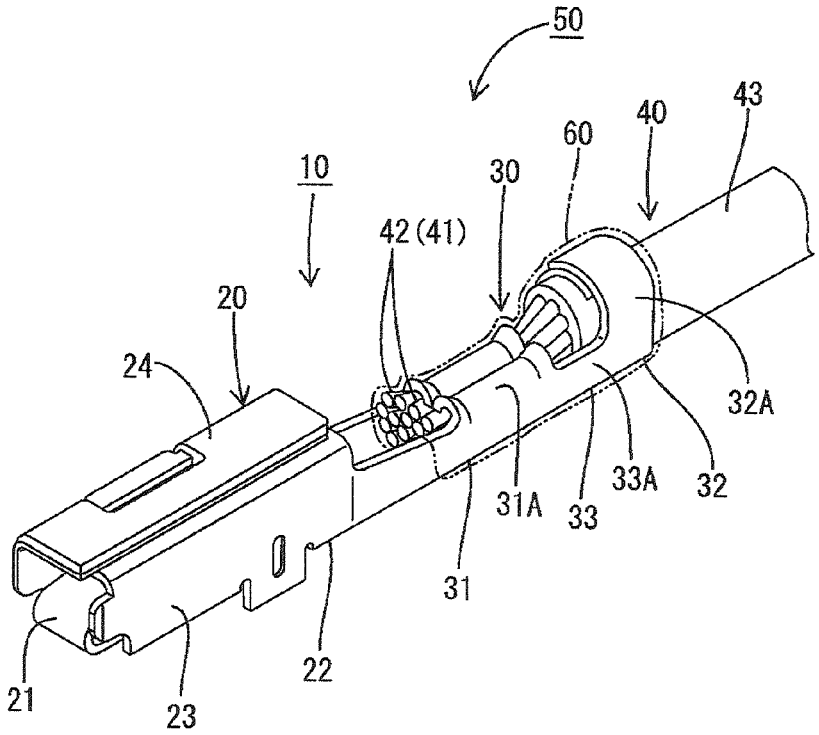
FIG. 1 is a perspective view showing a configuration of a terminal fitting according to a first embodiment of the present invention.
Figure 2:
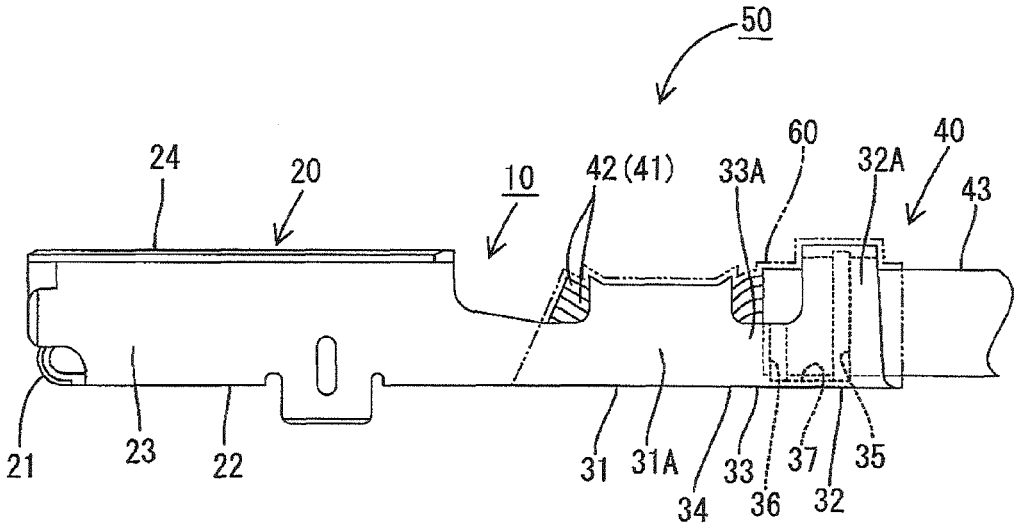
FIG. 2 is a side view of the terminal fitting.

A first embodiment of the present invention will be described with reference to FIGS. 1 to 8. A terminal fitting 10 in the present embodiment is made of copper alloy and as shown in FIGS. 1 and 2, includes a square-tubular body portion 20 and a crimping portion 30 provided in the rear of the body portion 20. The terminal of a coated electric wire 40 is crimped to the crimping portion 30 to configure an electric wire equipped with terminal fitting 50 as a whole. To the crimping portion 30 and a site of the coated electric wire 40 that is fixed to the crimping portion 30, an anti-corrosive agent 60 is applied. The anti-corrosive agent 60 that is undiluted is dropped or sprayed from above the terminal fitting 10 after the coated electric wire 40 is crimped and fixed to the crimping portion 30 and left as it is for a predetermined time to become solidified. Although in the present embodiment, the terminal fitting 10 is exemplified as a female terminal fitting having the body portion 20, for example, a tab-shaped male terminal fitting may be employed.

The coated electric wire 40 is made of aluminum and has a configuration where a core wire 42 obtained by twisting a plurality of metallic strands 41 is coated with an insulation coating (coating) 43 made of insulating synthetic resin. The metallic strands 41 may be made of any metal such as copper, copper alloy, aluminum, or aluminum alloy. The metallic strands 41 of the present embodiment are made of aluminum alloy.

The body portion 20 includes a bottom surface portion 22, a pair of side surface portions 23 rising from the respective side edges of the bottom surface portion 22, and a ceiling portion 24 formed in a two-ply manner by bending the respective upper edges of the side surface portions 23 toward each other.

Figure 3:
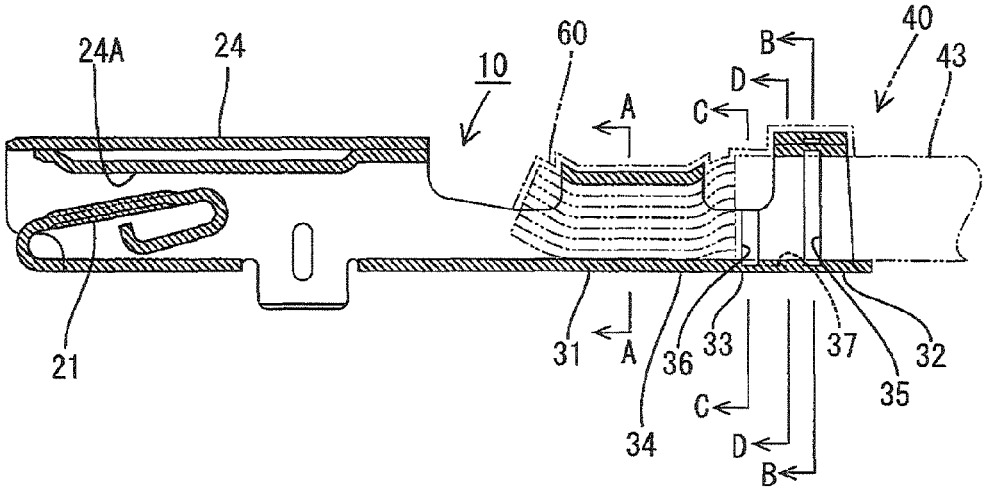
FIG. 3 is a side cross-sectional view of the terminal fitting.

Inside the body portion 20, as shown in FIG. 3, a flexible contact piece 21 is formed by folding back from the front edge of the bottom surface portion 22 of the body portion 20. In the body portion 20, between the flexible contact piece 21 and a surface (lower surface 24A of the ceiling portion 24) facing the flexible contact piece 21, a tab-shaped mating conductor (not shown) can be inserted.

The distance between the flexible contact piece 21 and the lower surface 24A of the ceiling portion 24 is smaller than the plate thickness of the mating conductor. Therefore, when the mating conductor is inserted between the flexible contact piece 21 and the lower surface 24*a* of the ceiling portion 24, the flexible contact piece 21 is gradually inserted as sagging downward until the mating conductor and the flexible contact piece 21 come in contact with each other elastically and are electrically connected to each other.

As shown in FIGS. 1 and 3, the crimping portion 30 includes a wire barrel 31 where the terminals of the core wires 42 of the coated electric wire 40 are crimped, an insulation barrel 32 provided in the rear of the wire barrel 31 and to which the insulation coating 43 of the coated electric wire 40 is fixed, and a coupling portion 33 coupling the wire barrel 31 and the insulation barrel 32 to each other. The wire barrel 31, the coupling portion 33, and the insulation barrel 32 share a bottom wall 34 continuing from the bottom surface portion 22 of the body portion 20 and extending in the longitudinal direction (axial direction of the coated wire 40) and including crimping segments 31A and 32A and side walls 33A extending from the respective side edges of the bottom wall 34, as shown in FIG. 4.

The wire barrel 31 is configured to crimp the core wires 42 by disposing the terminals of the core wires 42 along the longitudinal direction of the bottom wall 34 and crimping those terminals by using the pair of crimping segments 31A as shown in FIGS. 1 to 3. FIG. 5 shows a cross-sectional view of the wire barrel 31 in a crimped condition. When the core wires 42 come in contact with the inner surfaces of the crimping segments 31A and the bottom wall 34 conductively, the core wire 42 is electrically connected to the wire barrel 31. In the present embodiment, so-called heart-shape crimping is employed by which the outer circumference of the terminal of the core wire 42 is enclosed from the right and left sides while permitting the respective side edges of the two crimping segments 31A of the wire barrel 31 to abut against each other. The wire barrel 31 has a rectangular shape elongated in the cross direction (orthogonal to the longitudinal direction) in the open state before the coated electric wire 40 is crimped as shown in FIG. 4.

Figure 6:
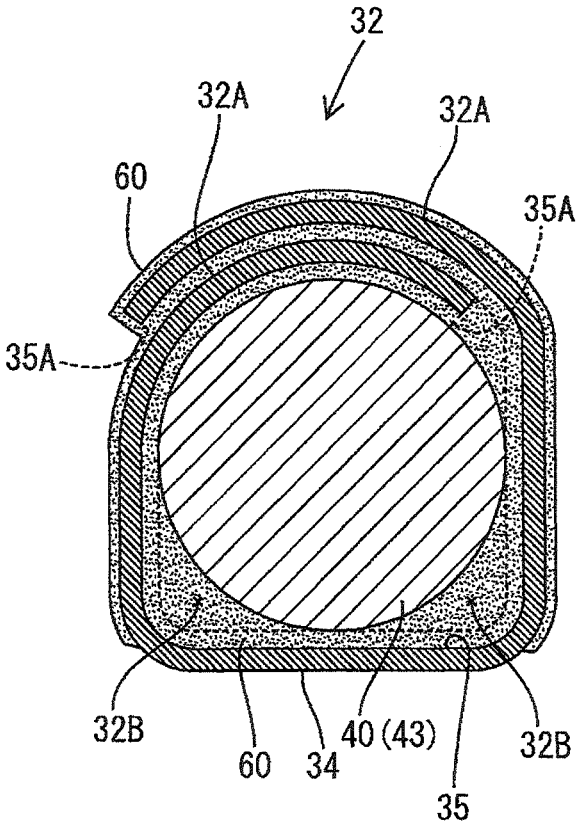
FIG. 6 is a cross-sectional view taken along line B-B of the terminal fitting of FIG. 3.

The insulation barrel 32 is configured to fix the coated electric wire 40 thereto by disposing the insulation coating 43 of the coated electric wire 40 along the longitudinal direction of the bottom wall 34 and crimping the insulation coating 43 by using the two crimping segments 32A as shown in FIGS. 1 to 3. The insulation barrel 32 has a rectangular shape elongated in the cross direction (orthogonal to the longitudinal direction) in the open state before the coated electric wire 40 is crimped as shown in FIG. 4. FIG. 6 shows a cross-sectional view of the insulation barrel 32 in a crimped condition. As shown in FIG. 6, in the present embodiment, so-called overlapping-type crimping is employed by which the two crimping segments 32A of the insulation barrel 32 enclose the outer circumference of the insulation coating 43 from the right and left sides while overlapping respective side edges of the crimping segments 32A with each other.

Figure 4:
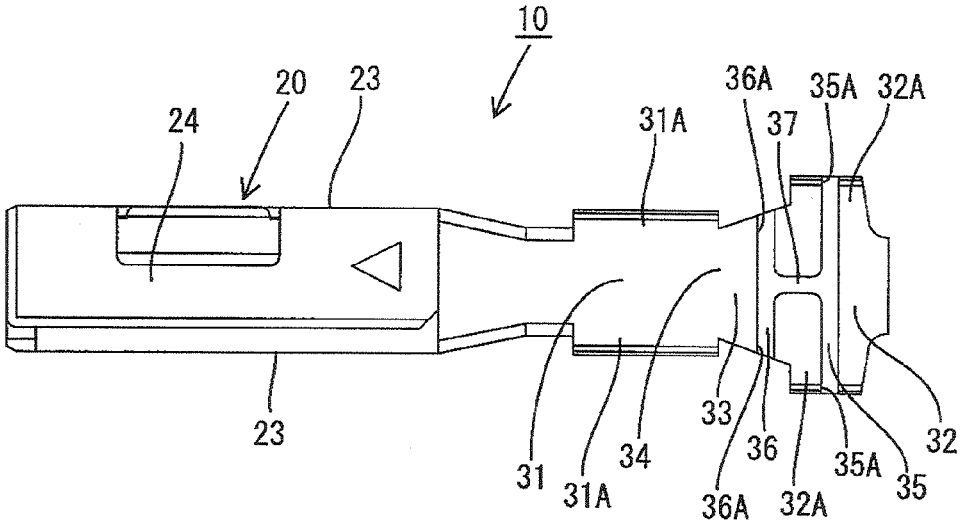
FIG. 4 is a plan view showing a state where a wire barrel, a coupling portion, and an insulation barrel of the terminal fitting are opened up.
Figure 5:
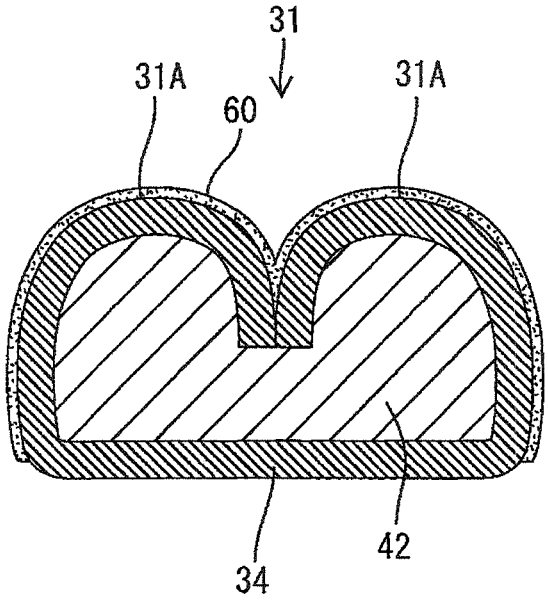
FIG. 5 is a cross-sectional view taken along line A-A of the terminal fitting of FIG. 3.

In the surface of the insulation barrel 32 that is in contact with the coated electric wire 40, an auxiliary lead-in groove 35 to introduce an anti-corrosive agent is formed as shown in FIGS. 4 and 6. The auxiliary lead-in groove 35 continuously extends straightly (in a belt shape) over the bottom wall 34 and the crimping segments 32A of this insulation barrel 32. The auxiliary lead-in groove 35 extends in a direction substantially orthogonal to the axial direction of the coated electric wire 40 and has openings 35A provided at two end portions of the groove 35. The openings 35A open at the side edges of the two crimping segments 31A of the insulation barrel 32. The auxiliary lead-in groove 35 has a depth about a half of the thickness of the bottom wall 34 and the two crimping segments 32A and has a substantially rectangular cross section (see FIGS. 3 and 6). The auxiliary lead-in groove 35 may be formed by beating down or scraping out the corresponding site of the insulation barrel 32 or denting the site beforehand in metal molding. The anti-corrosive agent 60 filling the auxiliary lead-in groove 35 forms an anti-corrosive wall in a manner to enclose the outer circumferential portion of the coated electric wire 40 as shown in FIG. 6. Moreover, below the coated electric wire 40, that is, a gap 32B between the insulation barrel 32 and the coated electric wire 40 is also filled with the anti-corrosive agent 60 spilt over from the auxiliary lead-in groove 35.

The wire barrel 31 and the insulation barrel 32 are coupled to each other by the coupling portion 33. As shown in FIGS. 1 to 3, the coupling portion 33 has a pair of side walls 33A rising from the two side edges of the bottom wall 34 to sandwich the outer circumferential portion of the insulation coating 43 from the right and left sides and having a substantially U-shaped cross section as shown in FIG. 7.

Figure 7:
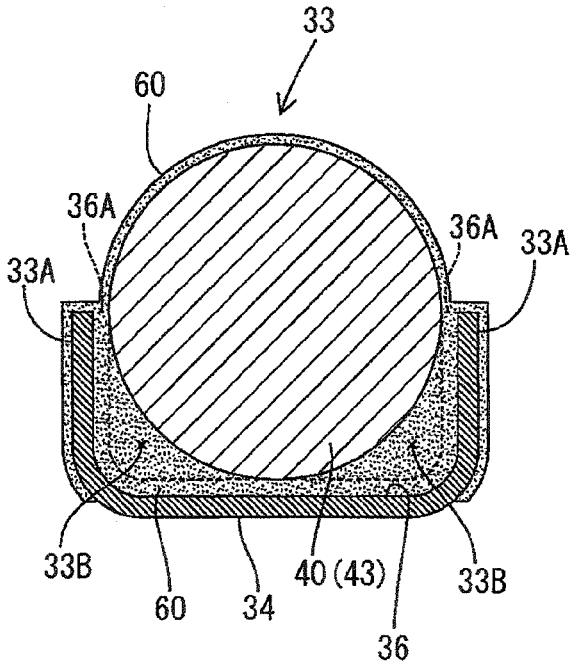
FIG. 7 is a cross-sectional view taken along line C-C of the terminal fitting of FIG. 3.

As shown in FIGS. 4 and 7, in the surface of the coupling portion 33 coming in contact with the coated electric wire 40 (more specifically, the surface coming in contact with the insulation coating 43), an lead-in groove 36 to introduce an anti-corrosive agent is formed. The lead-in groove 36 continuously extends straightly (in a belt shape) over the bottom wall 34 and the side wall 33A of the coupling portion 33. The lead-in groove 36 extends in a direction substantially orthogonal to the axial direction of the coated electric wire 40 and has openings 36A provided at end portions of the groove 36. The openings 36A open at the side edges of the two side walls 33A of the coupling proton 33. The lead-in groove 36 has a depth about a half of the thickness of the bottom wall 34 and the two side walls 33A and has substantially a rectangular cross section (see FIGS. 3 and 7). The lead-in groove 36 may be formed by a method similar to a method of forming the auxiliary lead-in groove 35. The lead-in groove 36 is filled with the anti-corrosive agent 60 and has an anti-corrosive wall formed in a manner to enclose the outer circumferential portion of the coated electric wire 40 as shown in FIG. 7. Moreover, below the coated electric wire 40, that is, a gap 33B between the coupling portion 33 and the coated electric wire 40 is also filled with the anti-corrosive agent 60 spilt over from the lead-in groove 36.

Figure 8:
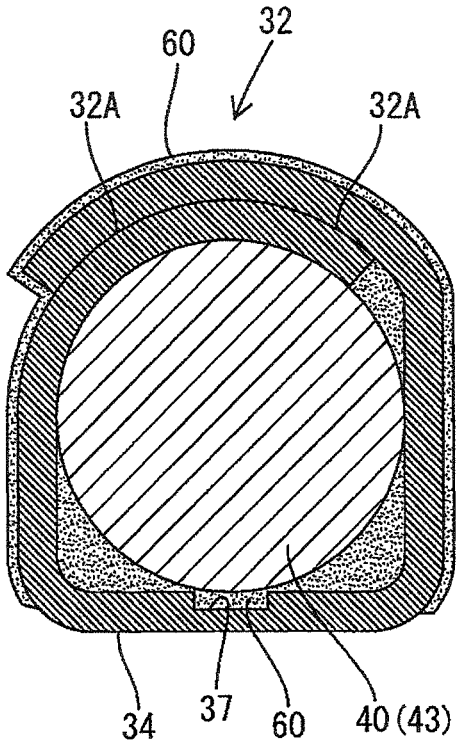
FIG. 8 is a cross-sectional view taken along line D-D of the terminal fitting of FIG. 3.

In the bottom wall 34 of the insulation barrel 32 and the coupling portion 33, a coupling groove 37 is formed to couple the lead-in groove 36 and the auxiliary lead-in groove 35 to each other as shown in FIGS. 3 and 4. The coupling groove 37 is formed at the central portion in the cross direction of the bottom wall 34. In addition, the coupling groove 37 has one end portion coupled to a central portion in the extending direction of the lead-in groove 36 and the other end portion coupled to a central portion in the extending direction of the auxiliary lead-in groove 35. The coupling groove 37 extends in the axial direction of the coated electric wire 40. That is, the coupling groove 37 is connected to the lead-in groove 36 as well as the auxiliary lead-in groove 35 in a substantially perpendicular manner. As shown in FIG. 8, the coupling groove 37 has a depth about a half of the thickness of the bottom wall 34 and has a substantially rectangular cross section. The coupling groove 37 is filled with the anti-corrosive agent 60 entered from the lead-in groove 36 or the auxiliary lead-in groove 35 into the terminal fitting 10. The coupling groove 37 may be formed by a method similar to a method of forming the lead-in groove 36 and the auxiliary lead-in groove 35.

The actions and effects of the terminal fitting 10 of the present embodiment having the above configuration will now be described below in comparison to a conventional terminal fitting having no lead-in groove or auxiliary lead-in groove to introduce an anti-corrosive agent.

Figure 9:
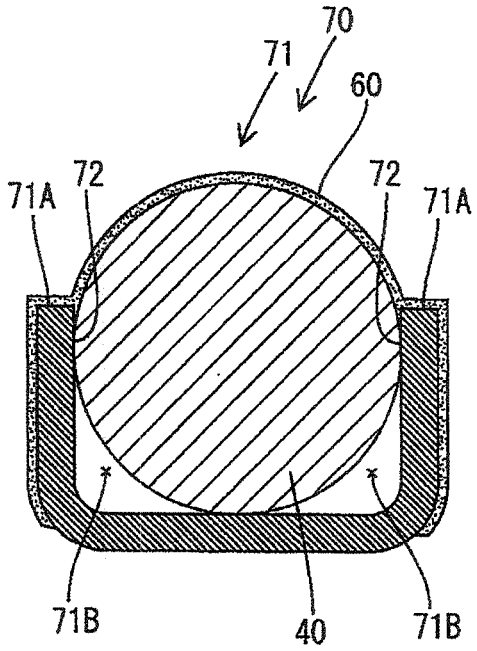
FIG.9 PRIOR ART
FIG. 9 is a cross-sectional view of the coupling portion of the terminal fitting in a conventional example.

As shown in FIG. 9, in a conventional terminal fitting 70, when the coated electric wire 40 is crimped and connected, a close-contact portion 72 is formed between the outer circumferential portion of the coated electric wire 40 and a side wall 71A in the right and left diametrical directions of the coated electric wire 40. The coated electric wire 40 has a substantially circular cross section, whereas a bottom wall 73 and side walls 71A of a coupling portion 71 have a substantially planar state and a U-shaped cross section as a whole. Therefore, a gap 71B is formed between the corner of the bottom wall 73 of the coupling portion 71 and the coated electric wire 40. As a result, the anti-corrosive agent 60 dropped or sprayed on the coupling portion 71 after the coated electric wire 40 is crimped is accumulated on the upper surface side of the coupling portion 71 and the coated electric wire 40, but inhibited by the close-contact portion 72 from entering downward. Therefore, the gap 71B is not filled with the anti-corrosive agent 60.

To solve the problem, in the present embodiment, the lead-in groove 36 is formed in the coupling portion 33 coupling the wire barrel 31 and the insulation barrel 32 to each other. Because of the lead-in groove 36, it is possible to form belt-shaped regions not directly coming in close contact with each other, between the coupling portion 33 and the coated electric wire 40. Accordingly, the anti-corrosive agent 60 coming from the opening 36A of the lead-in groove 36 can enter the site below the coated electric wire 40 at the coupling portion 33 through the lead-in groove 36. Since the lead-in groove 36 extends in a direction substantially orthogonal to the axial direction of the coated electric wire 40, the anti-corrosive agent 60 fills the lead-in groove 36 and then forms an anti-corrosive wall along this lead-in groove 36 in a manner to enclose the outer circumferential portion of the coated electric wire 40. Moreover, even when there is a gap (denoted by 33B in FIG. 7) partially between the coupling portion 33 and the coated electric wire 40, the gap 33B is filled with the anti-corrosive agent 60 spilt over from the lead-in groove 36. In such a manner, since the gap between the coated electric wire 40 and (the lead-in groove 36 in) the coupling portion 33 can be securely filled with the anti-corrosive agent 60, water content can be securely prevented from entering from the side of the insulation barrel 32 to the side of the wire barrel 31, thereby preventing the occurrence of electric corrosion.

In the present embodiment, the lead-in groove 36 has two end portions opened at the two side edges of the coupling portion 33. Therefore, the anti-corrosive-agent 60 can smoothly enter the lead-in groove 36.

In the present embodiment, since the auxiliary lead-in groove 35 is formed in the insulation barrel 32, even if the coated electric wire 40 is in close contact with the insulation barrel 32, the anti-corrosive agent 60 from the opening 35A enter the site below the coated electric wire 40 at the insulation barrel 32 through the auxiliary lead-in groove 35. Since the auxiliary lead-in groove 35 extends in a direction substantially orthogonal to the axial direction of the coated electric wire 40, the anti-corrosive agent 60 filling the auxiliary lead-in groove 35 forms an anti-corrosive wall along the auxiliary lead-in groove 35 in a manner to enclose the outer circumferential portion of the coated electric wire 40. Moreover, even when there is a gap (denoted by 32B in FIG. 6) partially between the insulation barrel 32 and the coated electric wire 40, the gap 32B is filled with the anti-corrosive agent 60 spilt over from the auxiliary lead-in groove 35. In such a manner, since the gap between the coated electric wire 40 and (the auxiliary lead-in groove 35 in) the insulation barrel 32 can be securely filled with the anti-corrosive agent 60, water content can be securely prevented from entering from the side of the insulation barrel 32 to the side of the wire barrel 31, thereby preventing the occurrence of electric corrosion.

In the present embodiment, the auxiliary lead-in groove 35 has two end portions opened at the two side edges of the insulation barrel 32. Therefore, the anti-corrosive-agent 60 can smoothly enter the lead-in groove 36.

In the present embodiment, since the coupling groove 37 extends to couple the lead-in groove 36 and the auxiliary lead-in groove 35 to each other, the anti-corrosive agent 60 having entered either the lead-in groove 36 or the auxiliary lead-in groove 35 can enter from the lead-in groove 36 to the auxiliary lead-in groove 35 or vice versa through the coupling groove 37. As a result, it is possible to securely fill the gap between each of the coupling portion 33 and the insulation barrel 32 and the coated electric wire 40 with the anti-corrosive agent 60.

Moreover, the electric wire equipped with terminal fitting 50 according to the present embodiment has a configuration where the terminal fitting 10 is crimped to the terminals of the core wires 42 in the coated electric wire 40 in which the core wires 42 are coated with the insulation coating 43. Therefore, it is possible to prevent the occurrence of electric corrosion, thereby using the electric wire 50 well for a long time.

In the present embodiment, the core wires 42 are made of aluminum alloy and the terminal fitting 10 is made of copper alloy. The core wires 42 of aluminum alloy allow the electric wire equipped with terminal fitting 50 to have lighter weight a whole. Further, by making the terminal fitting 10 of copper alloy, it can be stronger than the configuration where the terminal fitting 10 is made of aluminum. Therefore, the coated electric wire 40 can be fixed more strongly. Moreover, in a configuration where the core wires 42 and the terminal fitting 10 are made of different kinds of metals, electric corrosion, even though it easily occurs, can be prevented by the grooves 35, 36, and 37 according to the present embodiment.

Next, a second embodiment of the present invention will be described with reference to FIGS. 10 to 12. A terminal fitting 11 of the present embodiment has a modified configuration of the lead-in groove 36 of the first embodiment. The other configurations, actions, and effects are the same as those of the first embodiment, and repetitive description on them will be omitted.

Figure 10:
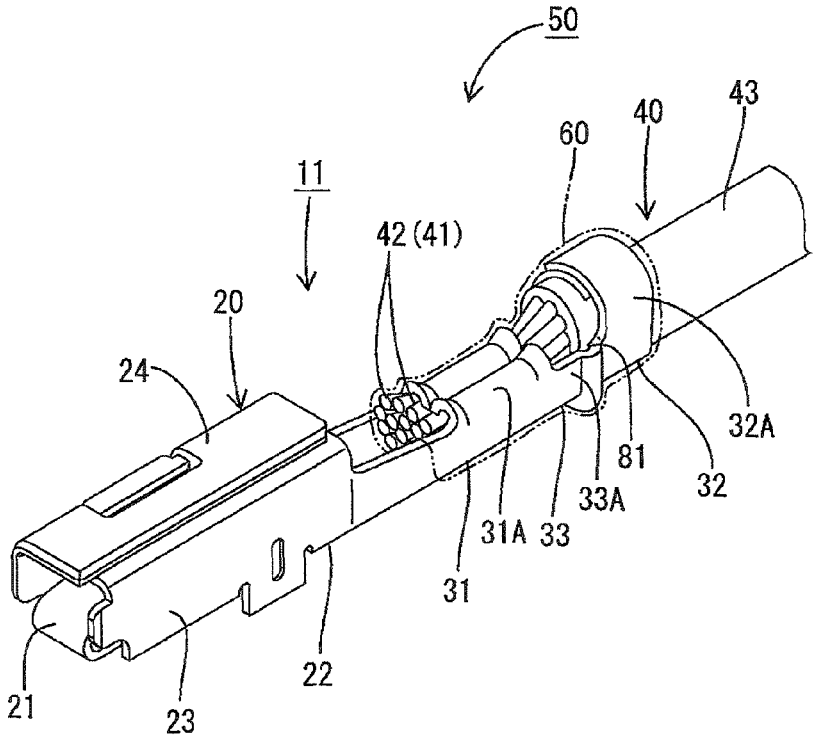
FIG. 10 is a perspective view showing a configuration of a terminal fitting according to a second embodiment of the present invention.
Figure 11:
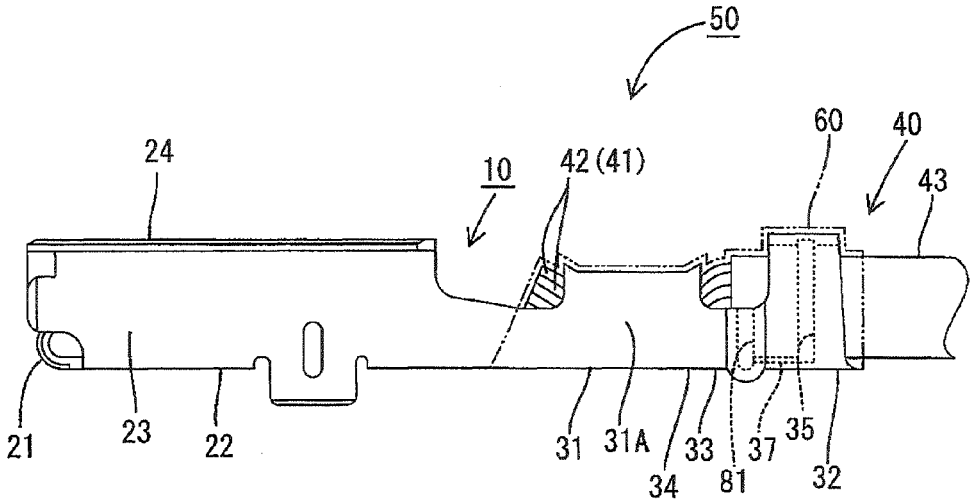
FIG. 11 is side view of the terminal fitting.
Figure 12:
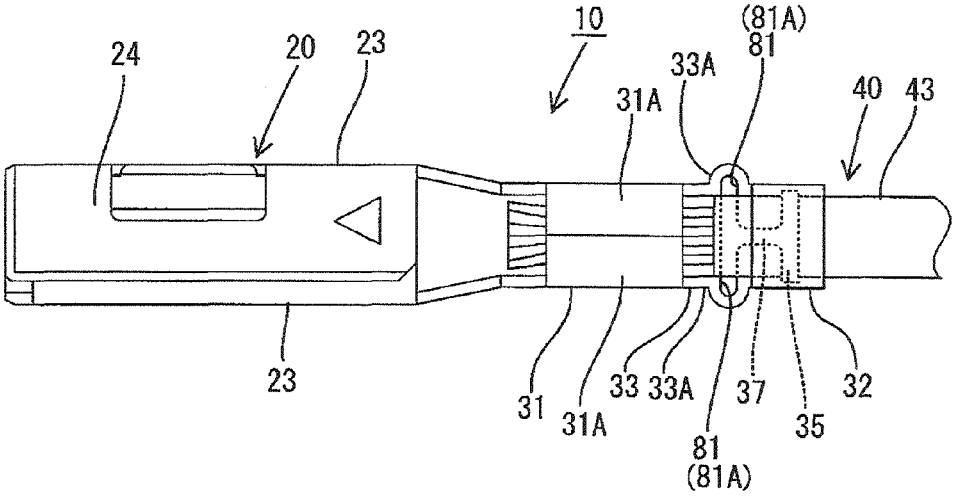
FIG. 12 is a top view of the terminal fitting.

In the terminal fitting 11 according to the present embodiment, as shown in FIGS. 10 to 12, an lead-in groove 81 to introduce an anti-corrosive agent is formed by beating out a bottom wall 34 and side walls 33A of a coupling portion 33 from the inner surface side (surface side coming in contact with a coated electric wire 40) to the outside. As a result, the lead-in groove 81 has a configuration where a plate wall expands outward convexly at the bottom wall 34 and the side walls 33A of the coupling portion 33. Specifically, in the present embodiment, as shown in FIG. 12, the lead-in groove 81 is beaten out into a circular-arc shape. Therefore, openings 81A have semi-circular cross sections opening at the two side edges of the side walls 33A.

According to this configuration, since the lead-in groove 81 is formed by beating out the coupling portion 33 formed of one sheet of metal segment, the lead-in groove 81 can be easily formed to contribute to cost saving. Further, since the depth of the lead-in groove 81 is not limited by the thicknesses of the bottom wall 34 and the side walls 33A of the coupling portion 33, it can be formed deeper than that of the first embodiment to permit the entrance of a larger amount of the anti-corrosive agent 60.

Although the embodiments of the present invention have been described, the present invention is not limited to the embodiments defined by the above description and figures. For example, the following embodiments are also included in the technical scope of the present invention.

Although the above embodiment each has exemplified the configuration where the lead-in groove, the auxiliary lead-in groove, and the coupling groove are all formed, the present invention only requires a configuration where at least the lead-in groove is formed in the coupling portion.

Although the above embodiments each has exemplified the configuration where the lead-in groove and the auxiliary lead-in groove have their end portions opened at the two side edges of the coupling portion and the insulation barrel, respectively, a configuration may be employed where at least one of the end portions is opened. In this configuration also, it is possible to permit the entrance of the anti-corrosive agent into the lead-in groove and the auxiliary lead-in groove.

Although the above embodiments each has exemplified the configuration where one lead-in groove and one auxiliary lead-in groove are provided, the number of each grooves is arbitrary and may be increased in order to enhance the waterproofing effects. Further, the depth of the grooves is also arbitrary.

Although the above embodiments each has exemplified the lead-in groove and the auxiliary lead-in groove having the rectangular or semi-circular cross sections, those cross sections may be arbitrary, trapezoidal or polygonal cross section is also applicable, for example.

Although the above embodiments each has exemplified the lead-in groove and the auxiliary lead-in groove extending in a direction substantially orthogonal to the axial direction of the coated electric wire, they may extend in a direction intersecting with the axial direction of the coated electric wire. Accordingly, the lead-in groove and the auxiliary lead-in groove are formed in a manner to enclose the outer circumferential portion of the coated electric wire. Therefore, a preferred anti-corrosive wall can be formed.

The above embodiments each has exemplified the configuration where the wire barrel is crimped in the heart shape in which the outer circumference of the terminals of the core wires are enclosed from the right and left sides while permitting the respective side edges of the two crimping segments to abut against each other. However, other than the crimping configuration described above, the so-called overlapping-type crimping configuration may be employed by which, for example, the two crimping segments enclose the outer circumference of the terminals of the core wires from the right and left sides while overlapping their respective side edges with each other. Further, it is also applicable that only one crimping segment may be provided.

Although the above embodiments each has exemplified the coated electric wire including the core wire composed of the plurality of metallic strands, the core wires may be formed of one metallic strand having a relatively large diameter, that is, the coated electric wire may be of the single core wire type, for example.

The present invention can be applied not only to the configuration where the copper alloy-made terminal fitting is connected to the aluminum-made electric wire exemplified in the above embodiments, but also to a wide range of the configurations where the core wire of the electric wire and the terminal fitting to be connected thereto may be made of the different types of metals. As the material of the terminal fitting, for example, copper excellent in strength is preferable.

The technology disclosed in the present description features a terminal fitting to be connected to a coated electric wire, the terminal fitting including: a wire barrel to be crimped on an exposed terminal of a core wire included in the coated electric wire; an insulation barrel provided in a rear of the wire barrel; and a coupling portion coupling the wire barrel and the insulation barrel to each other. The insulation barrel is configured to fix the coated electric wire. The coupling portion has a lead-in groove on a surface that is in contact with the coated electric wire. The lead-in groove is configured to introduce an anti-corrosive agent. The lead-in groove extends in a direction intersecting with an axial direction of the coated electric wire such that at least one end portion thereof is opened at at least one side edge of the coupling portion.

In addition to the configuration according to the first means, the lead-in groove may have two end portions opened at each side edge of the coupling portion.

According to the configuration of the second means, openings formed at the respective end portions of the lead-in groove allow the anti-corrosive agent to smoothly enter the lead-in groove.

In addition to the configuration according to the first or second means, the insulation barrel may have an auxiliary lead-in groove on a surface that is in contact with the coated electric wire. The auxiliary lead-in groove may be configured to introduce an anti-corrosive agent. The auxiliary lead-in groove may extend in a direction intersecting with the axial direction of the coated electric wire such that at least one end portion thereof is opened at at least one side edge of the insulation barrel.

According to the configuration of the third means, when an anti-corrosive agent is applied after the coated electric wire is crimped and fixed to the terminal fitting, the anti-corrosive agent enters an opening of the auxiliary lead-in groove at the coupling portion. In this context, even when the coated electric wire is in close contact with the insulation barrel of the terminal fitting, the anti-corrosive agent can enter the site below the coated electric wire at the insulation barrel through the auxiliary lead-in groove. Then, the anti-corrosive agent fills the auxiliary lead-in groove to thereby form an anti-corrosive wall along the auxiliary lead-in groove in the direction intersecting with the axial direction of the coated electric wire, that is, in a manner to enclose the outer circumferential portion of the coated electric wire. Moreover, even when there is a gap partially between the insulation barrel and the coated electric wire, the gap is filled with the anti-corrosive agent spilt over from the auxiliary lead-in groove. In such a manner, the gap between the coated electric wire and (the auxiliary lead-in groove in) the insulation barrel can be securely filled with the anti-corrosive agent. Therefore, water content is securely prevented from entering from the side of the insulation barrel to the side of the wire barrel also with the anti-corrosive wall formed in the lead-in groove, thereby preventing the occurrence of electric corrosion.

In addition to the configuration according to the third means, the auxiliary lead-in groove may have two end portions opened at each side edge of the insulation barrel.

According to the configuration of the fourth means, an opening formed at each of the two end portions of the auxiliary lead-in groove allows the anti-corrosive agent to smoothly enter the auxiliary lead-in groove.

In addition to the configuration according to the third or fourth means, the lead-in groove and the auxiliary lead-in groove are coupled to each other by a coupling groove, the coupling groove extending over a part of the coupling portion and a part of the insulation barrel.

When the anti-corrosive agent is applied to the terminal fitting, there may be a possibility that the anti-corrosive agent only enter either of the lead-in groove or the auxiliary lead-in groove. However, according to the configuration of the fifth means, the anti-corrosive agent entered either the lead-in groove or the auxiliary lead-in groove may enter from the lead-in groove to the auxiliary lead-in groove or vice versa through the coupling groove. As a result, it is possible to securely fill the gap between each of the coupling portion and the insulation barrel and the coated electric wire with the anti-corrosive agent.

Further, the technology disclosed in the present description may be applied to the electric wire equipped with a terminal fitting, including: a coated electric wire obtained by coating a core wire; and the terminal fitting according to any one of means 1 to 5, in which the terminal fitting is crimped on a terminal of the core wire included in the coated electric wire.

The electric wire equipped with terminal fitting according to the sixth means prevents the occurrence of electric corrosion, whereby the electric wire can be used well for a long time.

In addition to the configuration of the sixth means, the core wire may be made of one of aluminum and aluminum alloy and the terminal fitting may be made of one of copper and copper alloy.

According to the seventh means, the core wires of aluminum alloy allow the electric wire equipped with terminal fitting to have lighter weight as a whole. Further, the terminal fitting of copper alloy can be stronger and fix the coated electric wire more strongly than a configuration where the terminal fitting is made of aluminum. Moreover, in a configuration where the core wires and the terminal fitting are made of different kinds of metals, the occurrence of electric corrosion can be prevented all the more effectively by each of the grooves at the places where the electric corrosion may occur easily.

The invention claimed is:

1. A terminal fitting to be connected to a coated electric wire, the terminal fitting comprising:

a wire barrel to be crimped on an exposed terminal of a core wire included in the coated electric wire;

an insulation barrel provided in a rear of the wire barrel, the insulation barrel being configured to fix the coated electric wire; and a coupling portion coupling the wire barrel and the insulation barrel to each other, wherein:

the coupling portion has a lead-in groove on a surface that is in contact with the coated electric wire, the lead-in groove being configured to introduce an anti-corrosive agent;

the lead-in groove extends in a direction intersecting with an axial direction of the coated electric wire such that at least one end portion thereof is opened at at least one side edge of the coupling portion.

2. The terminal fitting according to claim 1, wherein the lead-in groove has two end portions opened at each side edge of the coupling portion.

3. The terminal fitting according to claim 1, wherein:

the insulation barrel has an auxiliary lead-in groove on a surface that is in contact with the coated electric wire, the auxiliary lead-in groove being configured to introduce an anti-corrosive agent; and the auxiliary lead-in groove extends in a direction intersecting with the axial direction of the coated electric wire such that at least one end portion thereof is opened at at least one side edge of the insulation barrel.

4. The terminal fitting according to claim 3, wherein the auxiliary lead-in groove has two end portions opened at each side edge of the insulation barrel.

5. The terminal fitting according to claim 3, wherein the lead-in groove and the auxiliary lead-in groove are coupled to each other by a coupling groove, the coupling groove extending over a part of the coupling portion and a part of the insulation barrel.

6. An electric wire equipped with a terminal fitting, comprising:

a coated electric wire obtained by coating a core wire; and the terminal fitting according to claim 1, wherein the terminal fitting is crimped on a terminal of the core wire included in the coated electric wire.

7. The electric wire equipped with the terminal fitting according to claim 6, wherein:

the core wire is made of one of aluminum and aluminum alloy; and the terminal fitting is made of one of copper and copper alloy.

8. The terminal fitting according to claim 2, wherein:

the insulation barrel has an auxiliary lead-in groove on a surface that is in contact with the coated electric wire, the auxiliary lead-in groove being configured to introduce an anti-corrosive agent; and the auxiliary lead-in groove extends in a direction intersecting with the axial direction of the coated electric wire such that at least one end portion thereof is opened at at least one side edge of the insulation barrel.

9. The terminal fitting according to claim 8, wherein the auxiliary lead-in groove has two end portions opened at each side edge of the insulation barrel.

10. The terminal fitting according to claim 8, wherein the lead-in groove and the auxiliary lead-in groove are coupled to each other by a coupling groove, the coupling groove extending over a part of the coupling portion and a part of the insulation barrel.

11. The terminal fitting according to claim 4, wherein the lead-in groove and the auxiliary lead-in groove are coupled to each other by a coupling groove, the coupling groove extending over a part of the coupling portion and a part of the insulation barrel.

12. The terminal fitting according to claim 9, wherein the lead-in groove and the auxiliary lead-in groove are coupled to each other by a coupling groove, the coupling groove extending over a part of the coupling portion and a part of the insulation barrel.

* * * * *